United States Patent [19]

Kasuga et al.

[11] 4,216,448

[45] Aug. 5, 1980

[54] MICROWAVE DISTRIBUTED-CONSTANT BAND-PASS FILTER COMPRISING PROJECTIONS ADJACENT ON CAPACITIVELY COUPLED RESONATOR RODS TO OPEN ENDS THEREOF

[75] Inventors: Osamu Kasuga; Satoru Omi; Tsutomu Kyuzaki, all of Tokyo, Japan

[73] Assignee: Nippon Electric Co., Ltd., Tokyo, Japan

[21] Appl. No.: 871,170

[22] Filed: Jan. 20, 1978

[30] Foreign Application Priority Data

Jan. 21, 1977 [JP] Japan ..... 52/4851

[51] Int. Cl.[2] ..... H01P 1/20; H01P 7/06; H01P 7/04

[52] U.S. Cl. ..... 333/203; 333/206; 333/212

[58] Field of Search ..... 333/73 R, 73 C, 73 S, 333/73 W, 82 B, 82 R, 83, 202, 207, 208, 209, 212, 222–226, 230, 231, 203

[56] References Cited

U.S. PATENT DOCUMENTS

| | | | |
|---|---|---|---|
| 2,749,523 | 6/1956 | Dishal | 333/73 W |
| 3,737,816 | 6/1973 | Honicke | 333/73 W |

FOREIGN PATENT DOCUMENTS

| | | | |
|---|---|---|---|
| 1942867 | 3/1971 | Fed. Rep. of Germany | 333/73 W |
| 2228942 | 1/1973 | Fed. Rep. of Germany | 333/82 B |
| 2161792 | 6/1973 | Fed. Rep. of Germany | 333/73 W |
| 2640210 | 9/1978 | Fed. Rep. of Germany | 333/73 C |

OTHER PUBLICATIONS

*IEEE Trans. on Microwave Theory and Techniques,* Jun. 1966, pp. 295–296, Kurzok, R. M. "General Four-Resonator Filters at Microwave Frequencies".

*Primary Examiner*—Alfred E. Smith
*Assistant Examiner*—Marvin Nussbaum
*Attorney, Agent, or Firm*—Sughrue, Rothwell, Mion, Zinn and Macpeak

[57] ABSTRACT

A microwave distributed-constant filter of a band-pass characteristic having at least one attenuation pole comprises resonator rods, each of which has an open and a shorted end and of which two first are inductively coupled in series through at least one second resonator rod. The first resonator rods are capacitively coupled direct to each other with a projection attached adjacent on at least one of the first resonator rods to the open end thereof. The first resonator rods may be coupled directly to input and output terminals of the filter. Alternatively, two third resonator rods may be interposed between the respective ones of the first resonator rods and the input and the output terminals. The third resonator rods may be inductively coupled direct to each other. As a further alternative, two fourth resonator rods may be interposed between the respective ones of the third resonator rods and the input and the output terminals with the third resonator rods inductively coupled direct to each other or with the third resonator rods capacitively coupled direct to each other by a projection attached adjacent on at least one of the third resonator rods to the open end thereof. The filter may be of the various coaxial types including the interdigital type.

9 Claims, 11 Drawing Figures

MICROWAVE DISTRIBUTED-CONSTANT BAND-PASS FILTER COMPRISING PROJECTIONS ADJACENT ON CAPACITIVELY COUPLED RESONATOR RODS TO OPEN ENDS THEREOF

BACKGROUND OF THE INVENTION

This invention relates to a distributed-constant band-pass filter for use in a microwave communication system.

In general, a band-pass filter has a passband between two cuttoff frequencies and attenuation bands on both sides in a finite frequency band of the passband. For microwave communication, use is made as the band-pass filter of a distributed-constant filter having a plurality of resonator rods. It is desirable for the band-pass filter to have sufficiently large attenuation in the attenuation band and sharp cutoff edges. A conventional distributed-constant filter is often of a Butterworth or Chebyshev response characteristic and has no attenuation pole outside in the finite frequency band of the passband. Use is therefore inevitable of a band-reject filter in combination with the band-pass filter to accomplish the large attenuation and the sharp cutoff edges.

In "IEEE Transactions on Microwave Theory and Techniques" (June 1966), pp 295–296, R. M. Kurzrok proposed a microwave distributed-constant filter comprising two first resonator rods coupled to an input and an output terminal, two second resonator rods inductively coupled in series between the first resonator rods, and a coupling probe between the first resonator rods. The proposed bandpass filter is of a band-pass characteristic having two attenuation poles in the finite frequency band and consequently has sharp cutoff edges. Assembly of the filter is, however, complicated because the coupling probe has to be insulated from the first resonator rods. The filter is fragile against a mechanical shock. Moreover, the frequencies at which the attenuation poles appear are not adjustable because it is impossible to adjust the coupling probe that determines the attenuation pole frequencies.

SUMMARY OF THE INVENTION

It is therefore an object of this invention to provide a microwave distributed-constant filter which has a large attenuation characteristics and at least one sharp cutoff edge.

It is another object of this invention to provide a microwave distributed-constant filter of the type described, for which the frequency at which an attenuation pole appears is readily adjustable over a wide frequency range.

It is a further object of this invention to provide a microwave distributed-constant filter of the type described, which is readily manufactured and is strong against a mechanical shock.

A microwave distributed-constant filter to which this invention is applicable is of band-pass characteristics having at least one attenuation pole in a finite frequency band and is responsive to an input signal of an input frequency band included in the finite frequency band for producing an output signal in an output frequency band predetermined in the finite frequency band. The filter comprises an input and an output terminal for the input and output signals, two first resonator rods, at least one second resonator rod, first coupling means for capacitively coupling the first resonator rods direct to each other, second coupling means for inductively coupling the first resonator rods through the second resonator rod, and third coupling means for coupling the first resonator rods to the input and the output terminals, respectively. Each of the first and second resonator rods has an open end, a shorted end, and a middle point between the open and the shorted ends. According to this invention, the first coupling means comprises a projection on one of the first resonator rods between the open end and the middle point of said one of the first resonator rods. The projection is directed to the other of the first resonator rods.

BRIEF DESCRIPTION OF THE DRAWING

FIG. 6, is a graph of attenuation characteristics of the band-pass filters according to the fourth and fifth embodiments.

DESCRIPTION OF THE PREFERRED EMBODIMENTS

Figure 1:
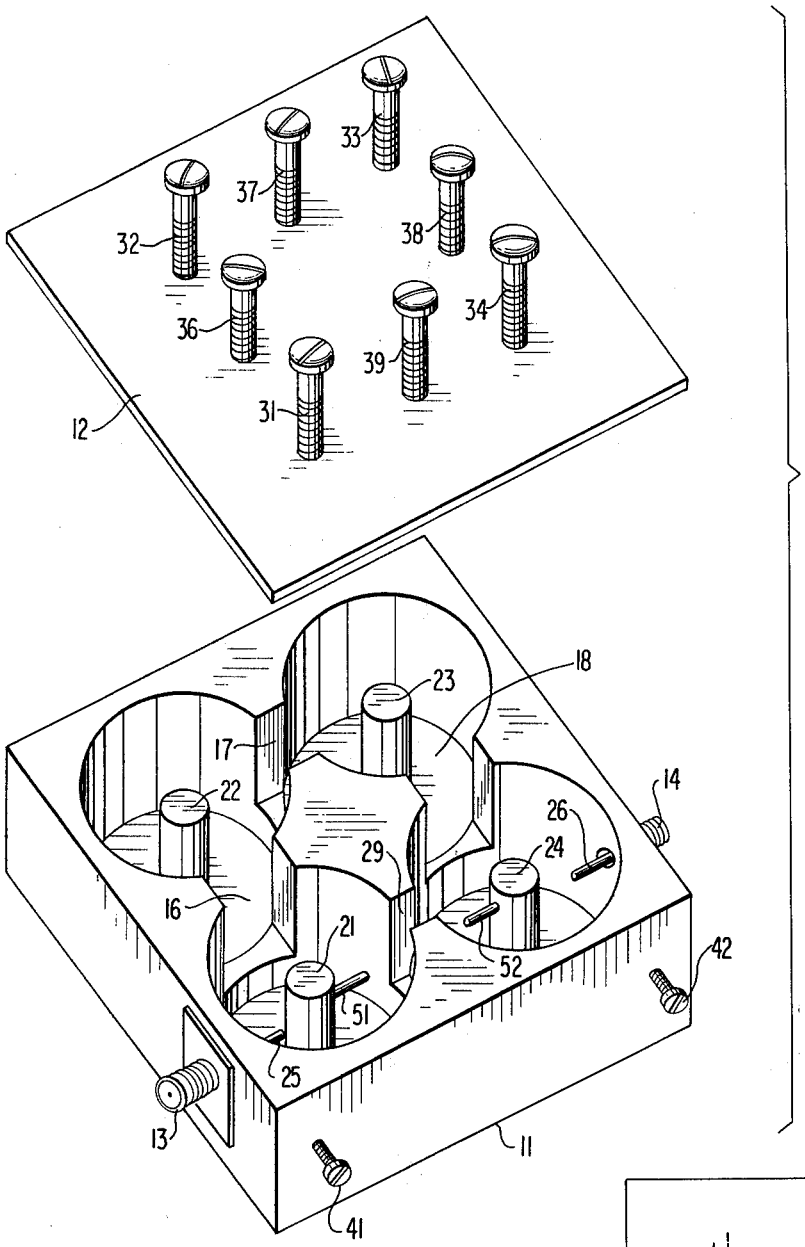
FIG. 1 is an exploded view of a band-pass filter according to a first embodiment of this invention.

Referring to FIG. 1, a band-pass filter according to a first embodiment of this invention comprises a case member 11 and a cap member 12 both of which are conductors to be grounded on use. The case member 11 is of a rectangular parallelepiped in outline, having a bottom and a top, a front, a back, and two side surfaces, and supports input and output terminals 13 and 14 offset on the side surfaces, respectively, relative to a vertical bisector of each side surface. Four vertical cylindrical cavities are formed in the case member 11 to be connected in series to one another by three coupling apertures or windows 16, 17, and 18 and coaxially accommodate first, second, third, and fourth resonator rods, 21, 22, 23, and 24. Each of the resonator rods 21 through 24 has a shorted end connected to the bottom of the case member 11 and an open end that does not reach the top surface. The coupling windows 16 through 18 inductively couple the resonator rods 21 through 24 in series. The first and fourth resonator rods 21 and 24 are coupled to the input and the output terminals 13 and 14 through input and output antennas 25 and 26, respectively, so that an input signal supplied to the input terminal 13 may appear as an output signal at the output terminal 14. It is to be noted that the input signal is of an input microwave frequency band included in a finite frequency band and that the output signal is in an output microwave frequency band predetermined in the finite frequency band. Each of the resonator rods 21 through 24 electrically acts as a resonator of a length substantially equal to a quarter wavelength of the signal passing by the resonator rods 21 through 24 or an odd multiple of the quarter wavelength.

Further referring to FIG. 1, the filter comprises an additional coupling window 29 between the cylindrical cavities for the first and the fourth resonator rods 21 and 24. As will later be described, the additional coupling window 29 serve to provide capacitive coupling between the first and the fourth resonator rods 21 and 24. Four first screws 31, 32, 33, and 34 are adjustably extended through the cap member 12 axially of the respective resonator rods 21 through 24 so as not to reach the open ends thereof. These screws 31 through 34 are for adjusting the electrical length of the resonator rods 21 through 24. Four second screws 36, 37, 38, and 39 are also extended through the cap member 12 so as to project into the coupling windows 16 through 18 and 29 for adjustment of the coupling provided thereby, respectively. The front surface of the case member 11 adjustably supports two screws 41 and 42 adjacent to the antennas 25 and 26 for controlling the coupling between the input and the output terminals 13 and 14 and the first and the fourth resonator rods 21 and 24, respectively. All of the screws 31 through 34, 36 through 39, and 41 and 42 are conductors. The filter further comprises a projection 51 on the first resonator rod 21 between the open end and a middle point thereof and an additional projection 52 similarly on the fourth resonator rod 24. The projections 51 and 52 may either be conductive or dielectric. The projections 51 and 52 capacitively couple the first and the fourth resonator rods 21 and 24 to each other through the additional coupling window 29. Preferably, the projections 51 and 52 are substantially perpendicular to the respective resonator rods 21 and 24 and are placed adjacent to the open ends thereof where the electric field is strongest. In other words, it is difficult to substantially realize desirable capacitive coupling when each of the projections 51 and 52 is mounted between the middle point and the shorted end of the respective resonator rods.

It is generally possible to capacitively couple the first and the fourth resonator rods 21 and 24 without the projections 51 and 52. For example, the additional coupling window 29 alone is capable of providing the capacitive coupling if the width from the top surface is restricted to render the window 29 shallow. The shallow window is, however, insufficient because of providing inductive coupling together with capacitive coupling.

Figure 1A:
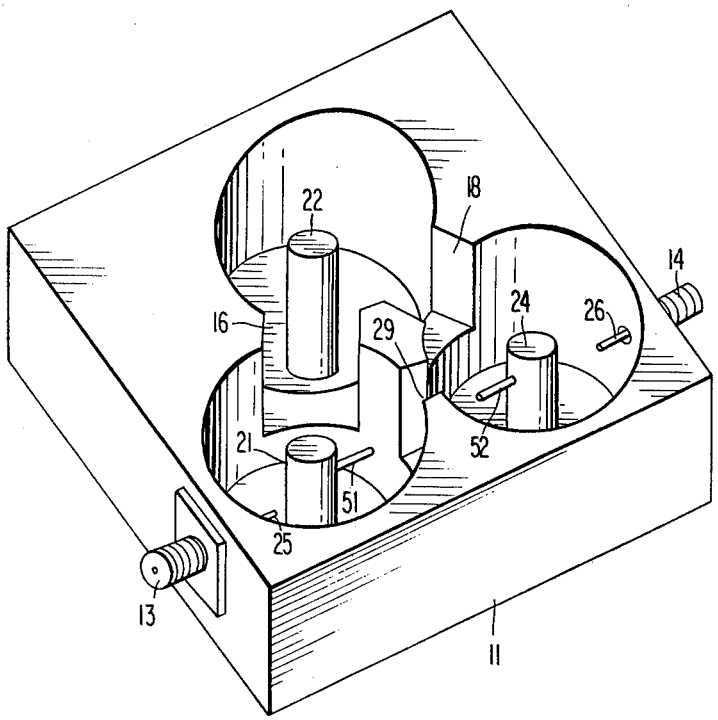
FIG. 1A shows a perspective view of a band-pass filter according to a modification of the first embodiment, the cap member not being shown in this view.

Instead of the capacitive coupling between the first and fourth resonator rods 21 and 24, use is possible of the capacitive coupling between the first and third resonator rods 21 and 23, which are inductively coupled in series with only one of the second resonator 22 interposed and with the fourth resonator rods 24 coupled only inductively to the third resonator rod 23 and coupled to the output terminal 14. Similarly, the fourth resonator rod 24 may be capacitively coupled to the second one 22 rather than to the first one 21. It is not necessary to have two second resonator rods, it being merely necessary that the first resonator rods being inductively coupled through at least 1 second resonator rod. A filter wherein only 1 second resonator rod at 22 is used to inductively couple the first resonator rods 21 and 24 is shown in FIG. 1A. This filter is simply a modification of the filter shown in FIG. 1 where the resonator rod 23 and its cavity and also window 17 are omitted.

Figure 2:
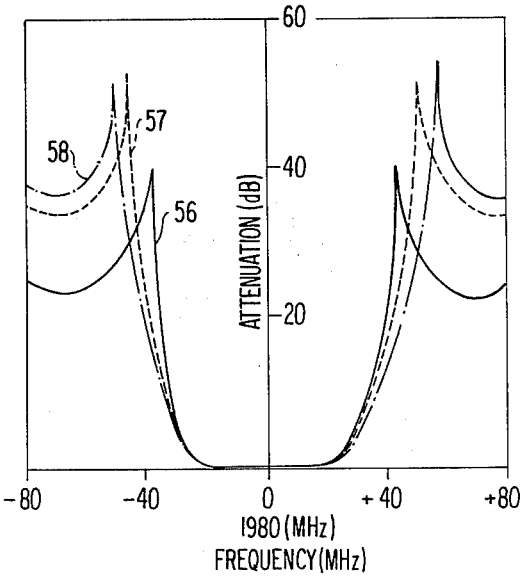
FIG. 2 is a graphical representation of attenuation characteristics of the band-pass filter according to the first embodiment.

Referring to FIG. 2, band-pass filters according to the first embodiment shown in FIG. 1 have frequency versus attenuation characteristics illustrated by first through third curves 56, 57, and 58 when the screw 39 is adjusted. Inasmuch as that component of the output signal which is produced through the inductive coupling is antiphase relative to another component of the output signal resulting from the capacitive coupling, attenuation poles occur at frequencies where both of the output signal components have an equal amplitude. It is therefore possible by adjusting the screw 39 to change the frequencies at which the attenuation poles appear. For example, the first curve 56 moves to the third curve 58 through the second curve 57 when the screw 39 for the additional coupling window 29 is thrusted further into the window 29. Use is made of resonator rods of 25 millimeters in length and 12 millimeters in diameter, projections of 10 millimeters in length and 3 millimeters in diameter, and cavities of 40 millimeters in diameter.

Figure 3:
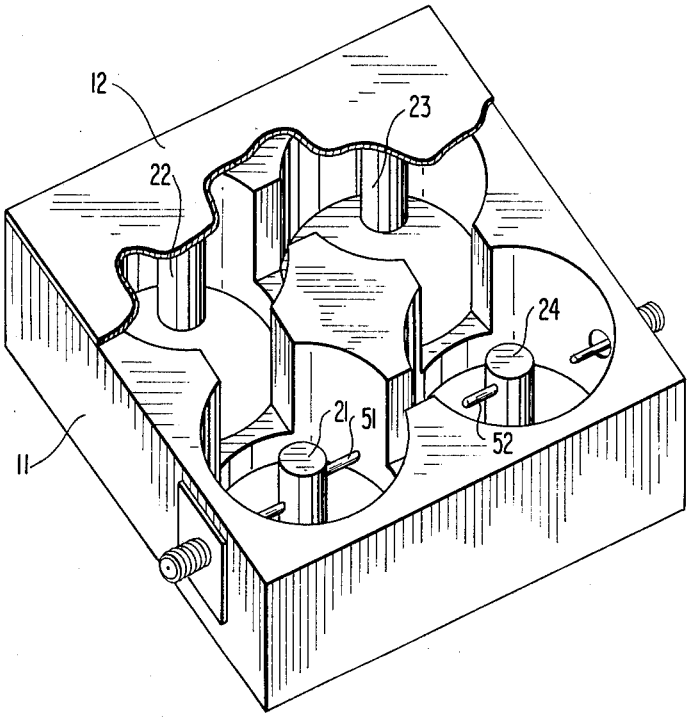
FIG. 3 shows a perspective view of a band-pass filter according to another modification of the first embodiment, with a cap member partially cut away.

Referring to FIG. 3, a band-pass filter according to a modification of the first embodiment of this invention comprises second and third resonator rods 22 and 23 attached to the cap member 12 rather than to the bottom of the case member 11. For simplicity of illustration, the screws 31 through 34, 36 through 39, and 41 and 42 are not depicted. It should be understood that the screws 32 and 33 for the second and third resonator rods 22 and 23 are extended axially through the rods 22 and 23 beyond the open ends thereof.

Figure 4:
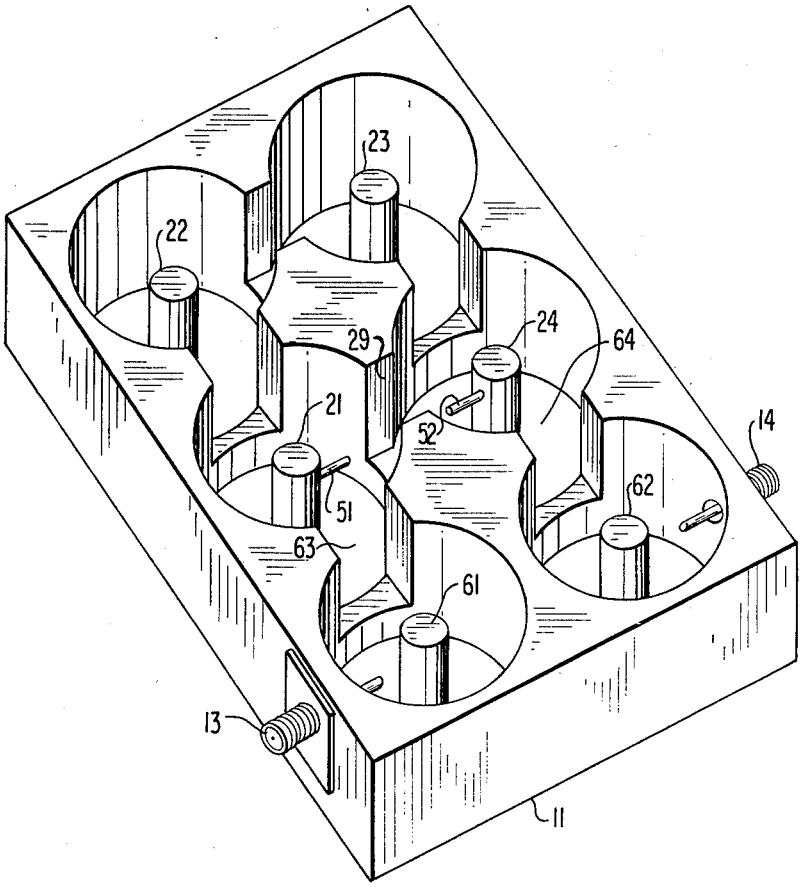
FIG. 4 shows a perspective view of a band-pass filter according to a second embodiment of this invention, with a cap member removed.

Referring to FIG. 4, a band-pass filter according to a second embodiment of this invention comprises a case member 11 having six cavities in order to accommodate six resonator rods and supporting input and output terminals 13 and 14. Besides resonator rods 21 through 24, the filter comprises two additional resonator rods 61 and 62. For convenience of description, the rods 21 and 24 are hereafter called first resonator rods; the rods 22 and 23, second resonator rods; and the rods 61 and 62, third resonator rods. As is the case with the band-pass filters illustrated with reference to FIGS. 1 and 3, two first resonator rods 21 and 24 are capacitively coupled direct to each other by means of an additional coupling window 29 and projections 51 and 52. The two third resonator rods 61 and 62 are inductively coupled to the two first resonator rods 21 and 24 through coupling windows 63 and 64, respectively, and coupled to the input and the output terminals 13 and 14. Besides the above-described screws, first and second screws (not shown) are preferably attached to the cap member 12 (FIGS. 1 and 3) to be adjustably thrusted towards the open ends of the third resonator rods 61 and 62 and into the coupling windows 63 and 64.

Figure 5:
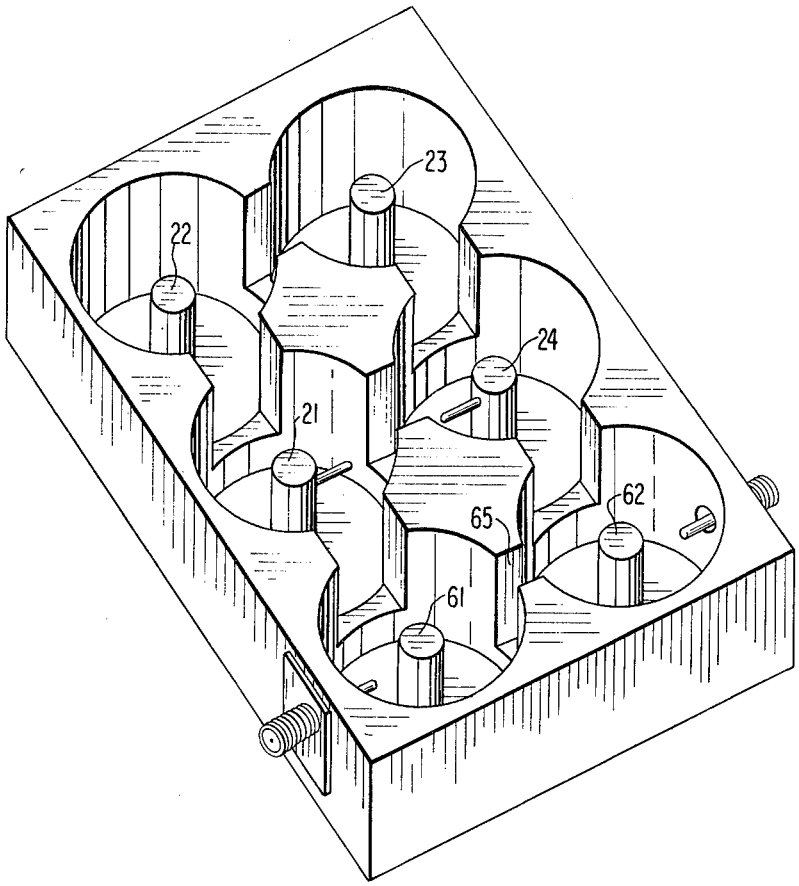
FIG. 5 shows a perspective view of a band-pass filter according to a third embodiment of this invention, with a cap member removed.

Referring to FIG. 5, a band-pass filter according to a third embodiment of this invention is similar to that according to the second embodiment except that the two third resonator rods 61 and 62 are inductively coupled direct to each other through still another coupling window 65. It is preferred that an additional screw (not shown) is adjustably thrusted into the coupling window 65.

Figure 6:
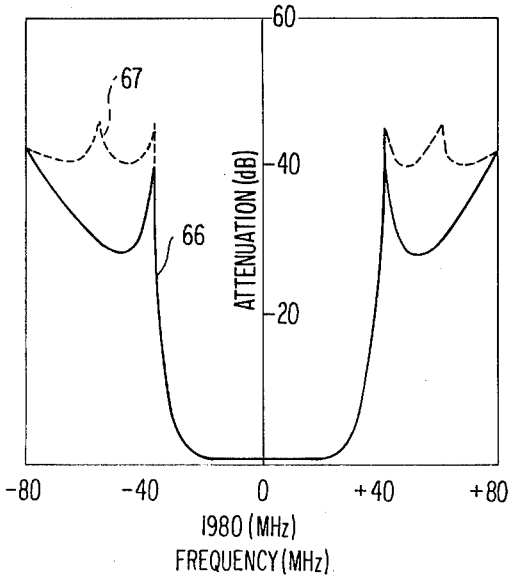
FIG. 6 is a graph of attenuation characteristics of the band-pass filters according to the second and the third embodiments.

Referring to FIG. 6, curves 66 and 67 represent attenuation characteristics of band-pass filters according to the second and the third embodiments, respectively. As is apparent from this figure, the band-pass filter according to the second embodiment has two attenuation poles in the finite frequency band while that according to the third embodiment has four attenuation poles.

Figure 7:
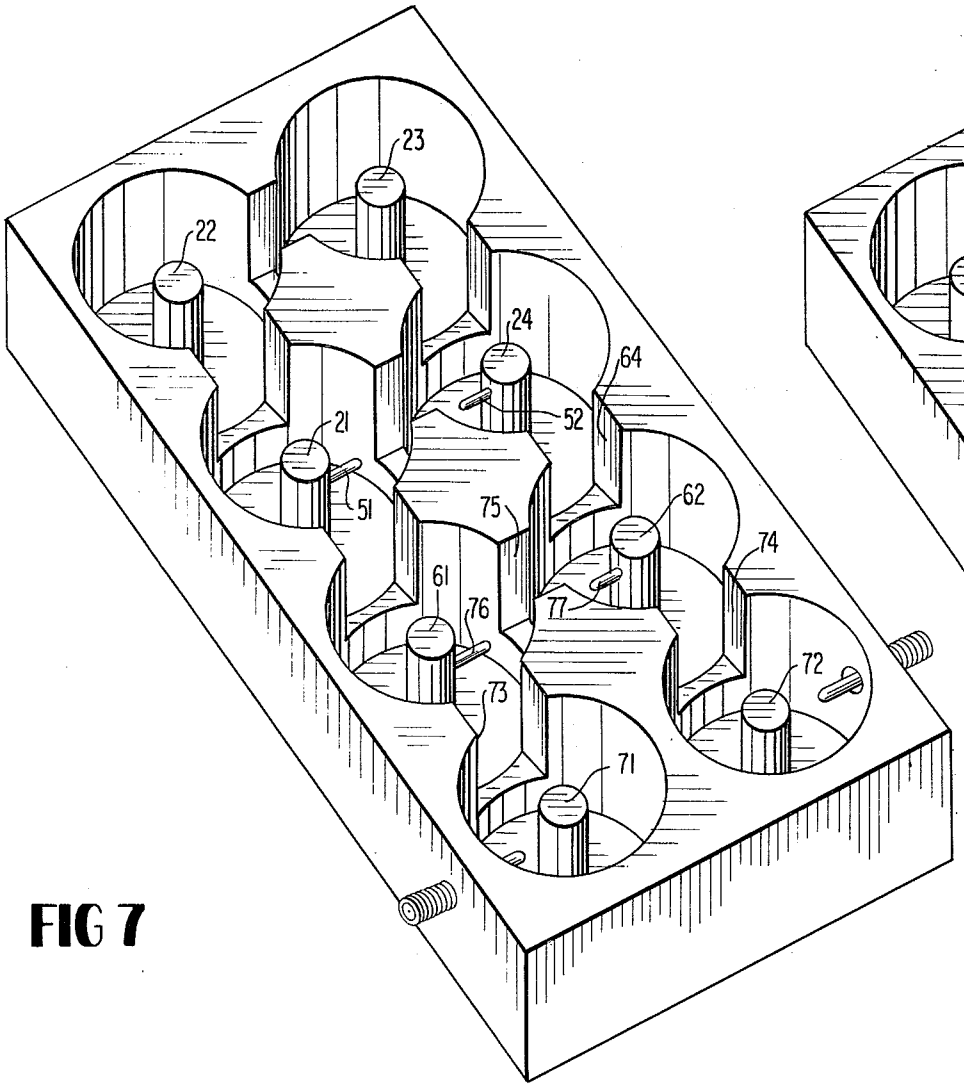
FIG. 7 shows a perspective view of a band-pass filter according to a fourth embodiment of this invention, with a cap member removed.

Referring to FIG. 7, a band-pass filter according to a fourth embodiment of this invention is similar to that illustrated with reference to FIG. 4 except that two fourth resonator rods 71 and 72 are inductively coupled to the third resonator rods 61 and 62 through coupling windows 73 and 74, respectively, and coupled direct to the input and the output terminals 13 and 14. The third resonator rods 61 and 62 are capacitively coupled to each other through a coupling window 75 and projections 76 and 77 of the type mentioned hereinabove.

Figure 8:
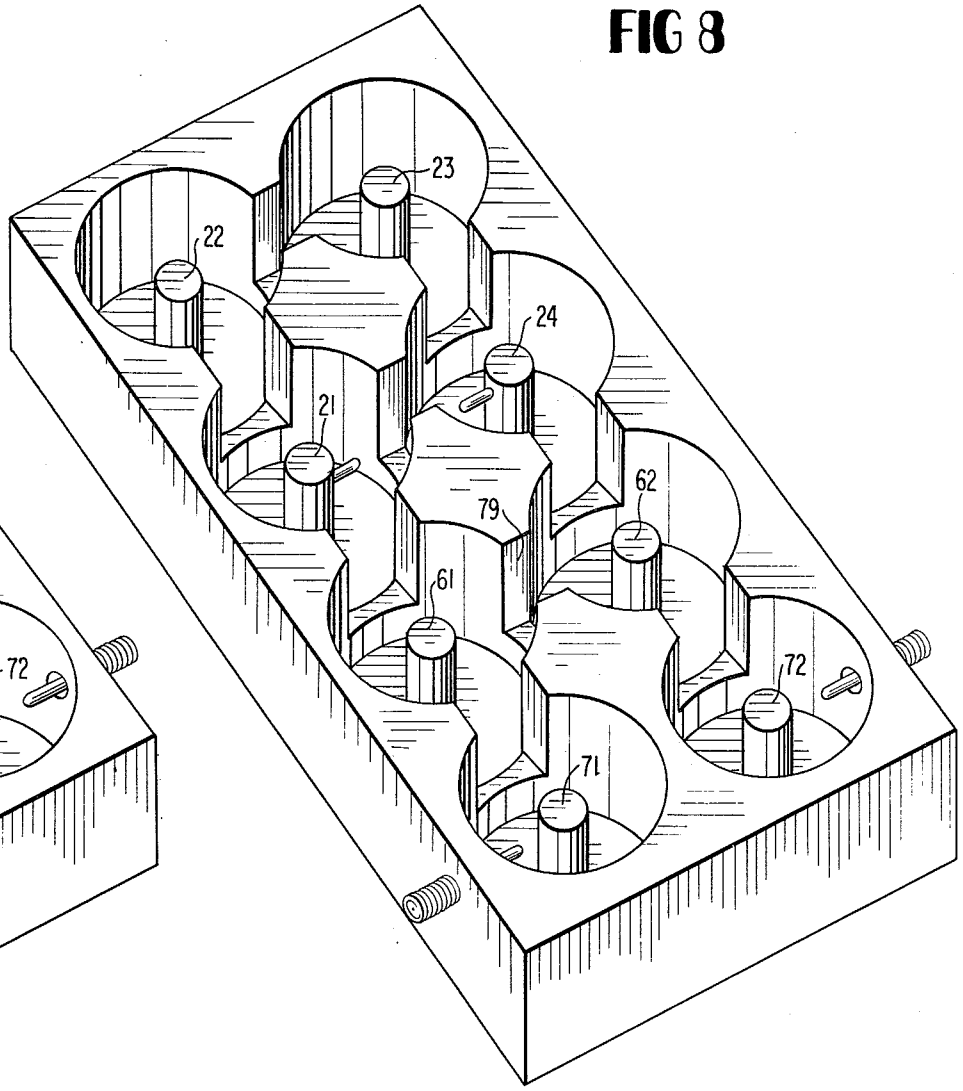
FIG. 8 shows a perspective view of a band-pass filter according to a fifth embodiment of this invention, with a cap member removed.

Referring to FIG. 8, a band-pass resonator according to a fifth embodiment of this invention is similar to that according to the fourth embodiment except that the third resonator rods 61 and 62 are inductively coupled to each other through a coupling window 79. Although not illustrated in both of FIGS. 7 and 8, it is preferred that screws are attached to the cap member to be adjustably thrusted towards the open ends of the fourth resonator rods 71 and 72 and into the coupling windows 75 (FIG. 7) and 79 (FIG. 8).

Figure 9:
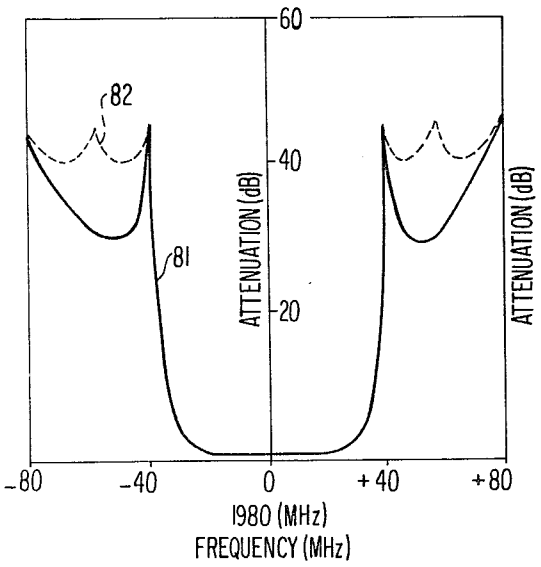
FIG. 9, depicted below

Referring to FIG. 9, curves 81 and 82 are representative of characteristics of band-pass filters according to the fourth and the fifth embodiments, respectively. As is apparent from this figure, the band-pass filter according to the fourth embodiment has two attenuation poles while the band-pass filter according to the fifth embodiment has four attenuation poles.

Figure 10:
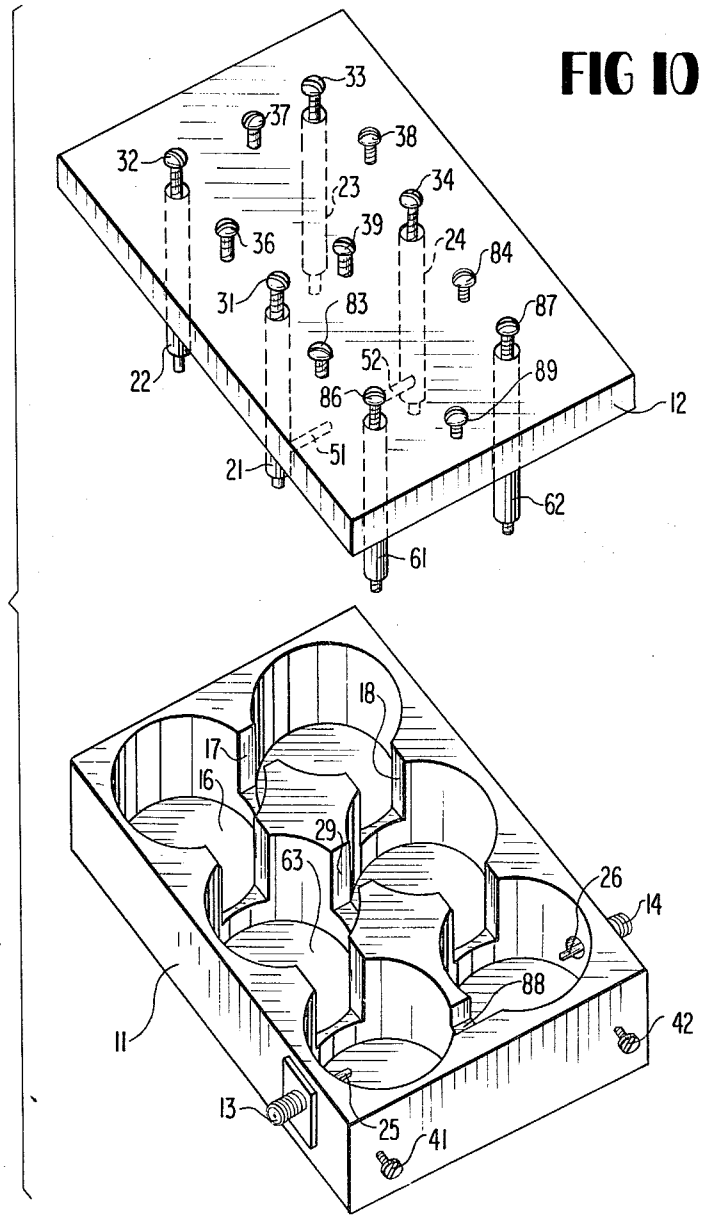
FIG. 10 is an exploded view of a band-pass filter according to a sixth embodiment of this invention.

Finally referring to FIG. 10, a band-pass filter according to a sixth embodiment of this invention comprises similar parts designated by like reference numerals as in FIGS. 1 and 5. The resonator rods 21 through 24 and 61 and 62 are attached to the cap member 12 so as to have shorted ends at the cap member 12 and open ends spaced in the respective cavities from the bottom of the case member 11. Screws for the coupling windows 63 and 64 are depicted at 83 and 84. The resonator rods 21 through 24 and 61 and 62 have axially tapped through holes for the first screws 31 through 34 described hereinabove and additional screws 86 and 87 for the third resonator rods 61 and 62. Although not explicitly described hereinabove, the coupling windows 16 through 18, 29, and the like are placed on center lines interconnecting the axes of the cylindrical cavities. Herein, a coupling window 88 for inductively coupling the third resonator rods 61 and 62 direct to each other is offset relative to the center line connecting the rods 61 and 62 and is shallower and narrower than the previously described corresponding coupling window 65 (FIG. 5). This renders the inductive coupling weaker to strengthen the attenuation given by those two of the four attenuation poles which appear outwardly of the other two attenuation poles relative to the passband. Preferably, the narrow and shallow coupling window 88 is offset relative to the center line by a quarter of the radius of the third resonator rods 61 and 62. A screw 89 for the window 88 is supported by the cap member 12 accordingly. It is readily understood that the offset shallower and narrower coupling window is applicable to a band-pass filter having the third resonator rods 61 and 62 inductively coupled direct to each other.

While several embodiments of this invention have so far been described, it is now readily possible for those skilled in the art to modify the illustrated embodiments in various manners. For example, the number of the resonator rods may be optionally selected if it is not less than three. The projection may be attached on only one of two capacitively coupled resonator rods, such as 21 and 24 or 61 and 62. An additional projection may be attached to each of the capacitively coupled rods. Further, this invention is also applicable to band-pass filters of an interdigital type and of a comb line type having no coupling window between resonator rods but coupling through a space between the adjacent resonator rods. Finally, the resonator rods having the projections may be shorter in length than a quarter wavelength of the signal passing through the filter because the electrical length of each of the resonator rods may be substantially varied by attaching the projection.

What is claimed is:

1. In a microwave distributed-constant filter of band-pass characteristics having at least one attenuation pole in a finite frequency band, said filter being responsive to an input signal of an input frequency band included in said finite frequency band for producing an output signal in an output frequency band predetermined in said finite frequency band and comprising an input and an output terminal for said input and output signals, two first resonator rods, a second resonator rod, first coupling means for capacitively coupling said first resonator rods direct to each other, second coupling means for inductively coupling said first resonator rods through said second resonator rod, and third coupling means for coupling said first resonator rods to said input and said output terminals, respectively, each of said first and second resonator rods having an open end, a shorted end, and a middle point between said open and said shorted ends, the improvement wherein said first coupling means comprises a projection on each of said first resonator rods between the open end and the middle point of each of the first resonator rods, the said projections being directed to each other.

2. A microwave distributed-constant filter as claimed in claim 1, wherein said second coupling means comprises means for inductively coupling one of said first resonator rods to said second resonator rod, and further comprising an additional second resonator rod between the first-mentioned second resonator rod and the other of said first resonator rods, and means for inductively coupling the first-mentioned second resonator rod and said other of said first resonator rods through said additional second resonator rod.

3. A microwave distributed-constant filter as claimed in claim 2, wherein said third coupling means comprises means for directly coupling said first resonator rods to said input and said output terminals, respectively.

4. A microwave distributed-constant filter as claimed in claim 2, wherein said third coupling means comprises two third resonator rods, means for inductively coupling said third resonator rods direct to said first resonator rods, respectively, and fourth coupling means for coupling said third resonator rods to said input and said output terminals, respectively, each of said third resonator rods having an open and a shorted end.

5. A microwave distributed-constant filter as claimed in claim 4, further comprising additional coupling means for inductively coupling said third resonator rods direct to each other, said fourth coupling means comprising means for directly coupling said third resonator rods direct to said input and said output terminals, respectively.

6. A microwave distributed-constant filter as claimed in claim 4, wherein said fourth coupling means comprises two fourth resonator rods, means for inductively coupling said fourth resonator rods direct to said third resonator rods, respectively, and means for directly coupling said fourth resonator rods direct to said input and said output terminals, respectively, each of said fourth resonator rods having an open and a shorted end, said filter further comprising means for inductively coupling said third resonator rods direct to each other.

7. A microwave distributed-constant filter as claimed in claim 4, wherein said fourth coupling means comprises two fourth resonator rods, means for inductively coupling said fourth resonator rods direct to said third resonator rods, respectively, and means for directly coupling said fourth resonator rods direct to said input and said output terminals, respectively, each of said fourth resonator rods having an open and a shorted end, said filter further comprising fifth coupling means for capacitively coupling said third resonator rods direct to each other.

8. A microwave distributed-constant filter as claimed in claim 7, each of said third resonator rods having a middle point between the open and the shorted ends of said each third resonator rod, wherein said fifth coupling means comprises a projection on one of said third resonator rods between the open end and the middle point of said one of the third resonator rods, said projection being directed to the other of said third resonator rods.

9. A microwave distibuted-constant filter as claimed in claim 8, wherein said fifth coupling means comprises an additional projection on said other of the third resonator rods between the open end and the middle point of said other of the third resonator rods, said additional projection being directed to said one of the third resonator rods.

* * * * *

UNITED STATES PATENT AND TRADEMARK OFFICE

CERTIFICATE OF CORRECTION

PATENT NO. : 4,216,448

DATED : August 5, 1980

INVENTOR(S) : Osamu KASUGA et al.

It is certified that error appears in the above—identified patent and that said Letters Patent is hereby corrected as shown below:

Column 3, line 64, after "resonator" insert -- rod -- ;

line 65, delete "rods" and insert -- rod -- .

Signed and Sealed this

*Tenth* Day of *March 1981*

[SEAL]

*Attest:*

RENE D. TEGTMEYER

*Attesting Officer*

*Acting Commissioner of Patents and Trademarks*